US010538856B2

(12) United States Patent
Acosta et al.

(10) Patent No.: US 10,538,856 B2
(45) Date of Patent: Jan. 21, 2020

(54) APPARATUS AND METHOD FOR ELECTRO-POLISHING COMPLEX SHAPES

(71) Applicant: General Electric Company, Schenectady, NY (US)

(72) Inventors: Manuel Acosta, Cincinnati, OH (US); James J. O'Shea, Peabody, MA (US)

(73) Assignee: General Electric Company, Schenectady, NY (US)

( * ) Notice: Subject to any disclaimer, the term of this patent is extended or adjusted under 35 U.S.C. 154(b) by 259 days.

(21) Appl. No.: 15/584,715

(22) Filed: May 2, 2017

(65) Prior Publication Data

US 2018/0318951 A1 Nov. 8, 2018

(51) Int. Cl.
*C25F 3/16* (2006.01)
*C25F 7/00* (2006.01)

(52) U.S. Cl.
CPC . *C25F 3/16* (2013.01); *C25F 7/00* (2013.01)

(58) Field of Classification Search
CPC ..... C25F 3/16–3/28
See application file for complete search history.

(56) References Cited

U.S. PATENT DOCUMENTS

| | | | | |
|---|---|---|---|---|
| 6,619,913 | B2 | 9/2003 | Czachor et al. | |
| 7,246,990 | B2 | 7/2007 | Xie et al. | |
| 7,390,161 | B2 | 6/2008 | Xie et al. | |
| 8,021,102 | B2 | 9/2011 | Xie et al. | |
| 8,202,041 | B2 | 6/2012 | Wojtyczka et al. | |
| 8,402,769 | B2 | 3/2013 | Maltson | |
| 8,591,172 | B2 | 11/2013 | Bottome | |
| 8,658,006 | B2 * | 2/2014 | Bialas | C25F 7/00 204/199 |
| 8,672,609 | B2 | 3/2014 | Lussier et al. | |
| 8,757,958 | B2 | 6/2014 | Lussier | |
| 8,992,761 | B2 * | 3/2015 | Lin | A61F 2/86 205/660 |
| 9,150,980 | B2 * | 10/2015 | Loftus, Jr. | C25F 3/02 |
| 2012/0082541 | A1 | 4/2012 | Macchia et al. | |
| 2014/0286748 | A1 | 9/2014 | Costa et al. | |
| 2016/0097299 | A1 | 4/2016 | Evans | |

* cited by examiner

*Primary Examiner* — Nicholas A Smith
(74) *Attorney, Agent, or Firm* — General Electric; Kristi Davidson

(57) ABSTRACT

An apparatus for electro-polishing an object that has a complex shape that defines a cavity. The apparatus includes an electrode that is configured to closely engage a predetermined location of the object. The electrode is configured to be electrically connected to a power supply.

11 Claims, 4 Drawing Sheets

APPARATUS AND METHOD FOR ELECTRO-POLISHING COMPLEX SHAPES

BACKGROUND OF THE INVENTION

The present invention relates to an apparatus and method for electro-polishing complex shapes and more specifically, and apparatus and method for electro-polishing metal leading edges for composite fan blades.

Structures that travel at high speed and that are formed of composite materials can be clad by metals to provide additional strength to resist impacts. Such structures include the high speed fan blades of gas turbine engines that are formed of composite materials. Composite materials can have limited impact resistance in comparison with other materials such as metal alloys and therefore fan blades that include composite materials can also include metal leading edges (MLE's). The metal leading edge is polished to provide corrosion protection. One problem with conventional methods of producing MLE's is that they are difficult to polish because of their complex shape.

BRIEF DESCRIPTION OF THE INVENTION

This problem is addressed by an apparatus configured to electrically connect predetermined regions of complex shapes to an electrical pole.

According to one aspect of the technology described herein there is provided an apparatus for electro-polishing an object that has a complex shape that defines a cavity. The apparatus includes an electrode that is configured to closely engage a predetermined location of the object. The electrode is configured to be electrically connected to a power supply.

According to another aspect of the technology described herein there is provided a method for electro-polishing metal. The method includes the steps of: providing an object that has a wall and the wall defines a first surface that is to be polished and a second surface; positioning an electrode on the object to be polished such that the electrode is in contact with the second surface; connecting the electrode to a power supply; placing the object to be polished in an electrolyte solution such that the object is an anode; and passing current through the electrode.

BRIEF DESCRIPTION OF THE DRAWINGS

The invention may be best understood by reference to the following description, taken in conjunction with the accompanying drawing figures in which.

DETAILED DESCRIPTION OF THE INVENTION

Figure 1:
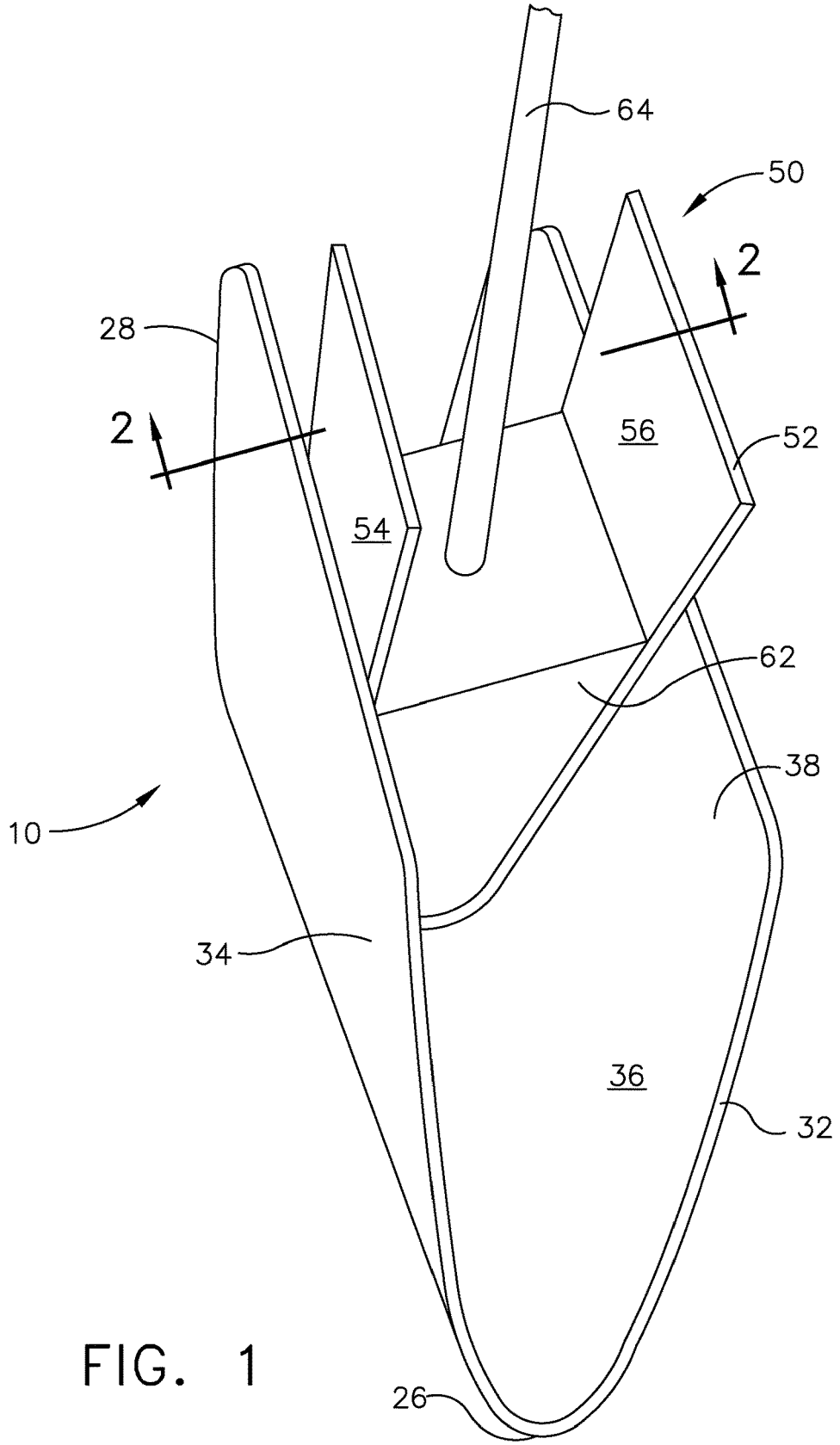
FIG. 1 is a perspective view of an electrode positioned within a metal leading edge (MLE)

Referring to the drawings wherein identical reference numerals denote the same elements throughout the various views, FIG. 1 depicts a metal leading edge ("MLE") 10 and an electrode 50. The electrode 50 is configured to promote electrical contact in a predetermined location of the MLE 10. In this regard, the electrode 50 is configured such that electro-polishing of the MLE 10 can be conducted in a controlled and precise manner.

Referring now to FIG. 1, the MLE 10 has a first end 28 and a second end 32 and a generally u-shaped cross section. A leading tip 26 is defined between the first end 28 and the second end 32 and can be curved, liner, undulating, or complexly shaped. The MLE 10 defines a first, exterior surface 34 and a second, inner surface 36. The inner surface 36 defines a cavity 38. By way of example and not limitation, the MLE 10 is formed from one of the following: alloys of steel, titanium, alloys of titanium, low and high carbon steels, tool steels, aluminum, titanium, copper, brass, Inconel®, bronze, Hastelloy®, tantalum, beryllium, silver, gold, molybdenum, tungsten, a variety of high temperature alloys (Nimonic®, Waspaloy®, and others), low and high Carbon steels, tool steels, aluminum, titanium, copper, brass, Inconel®, bronze, Hastelloy®, tantalum, and a combination thereof. By way of example and not limitation, an alloy of steel can be chosen from one of the following: stainless steel type 15-5, stainless steel type 17-4, stainless steel type 304, stainless steel type 316, stainless steel type 321, Nitronic® 60, other stainless steel alloys, and a combination thereof.

The electrode 50 is configured to be positioned within the cavity 38 of the MLE 10 as shown in FIG. 1. The electrode 50 includes an electrode wall 52 that is formed of an electrically conductive material such as copper. The wall 52 includes an outer surface 54 that is configured to closely engage the inner surface 36 of the MLE 10. More preferably, the outer surface 54 is configured to closely contact inner surface 36. An electrically conductive filler 62 is positioned against an inner surface 56 of the electrode wall 52 and the filler 62 has a conductor 64 attached to it. The filler 62 is a low-melt or fusible alloy. By way of example and not limitation, the filler 62 can be formed of one of the following: bismuth based alloys containing lead, tin, cadmium or other metals; copper based alloys; iron based alloys; aluminum based alloys; silver; gold; and a combination thereof. The conductor 64 as illustrated in FIG. 1 is a conductive wire that has one end electrically connected to the conductive filler 62.

Figure 2:
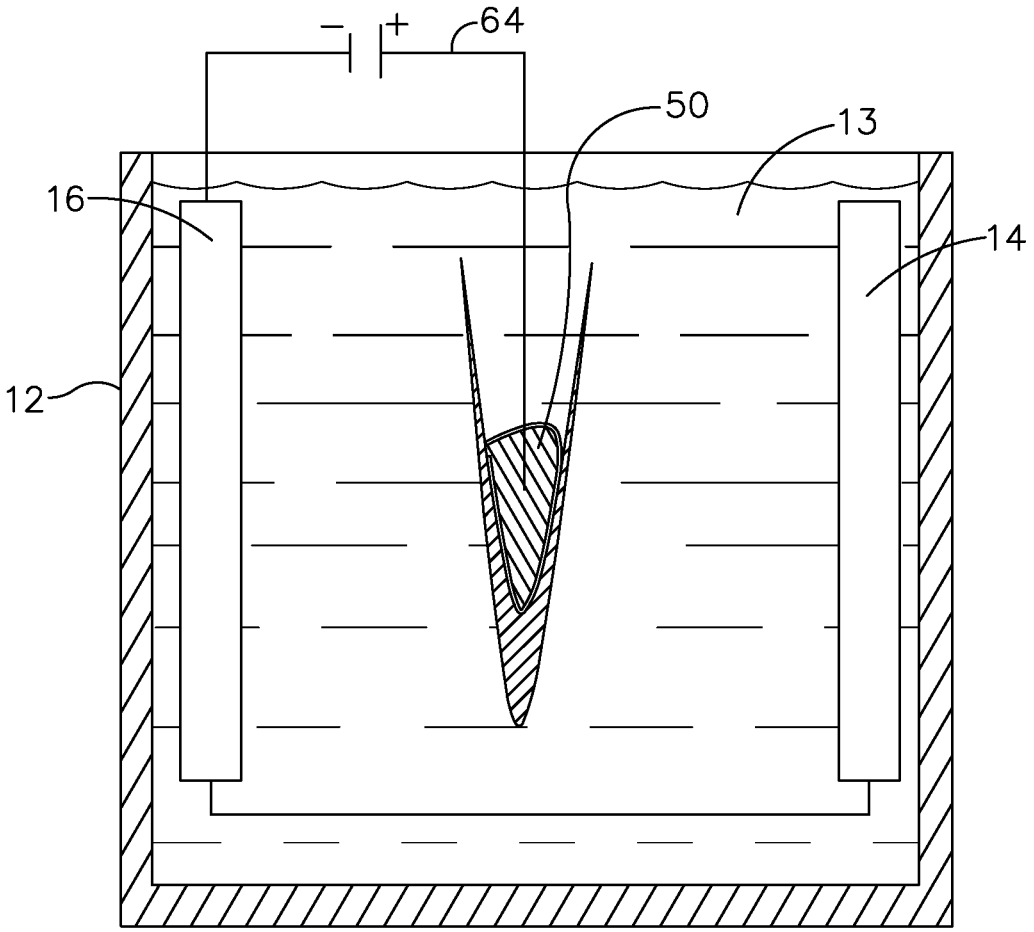
FIG. 2 is a sectional side view of the MLE and electrode shown in FIG. 1 positioned in a tank for electro-polishing.

Referring now to FIG. 2, the MLE 10 and the electrode 50 are configured to be positioned within a tank 12 such that they are at least partially submerged in an electrolyte solution 13. A pair of cathodes 14 and 16 are also positioned within the tank 12 such that they are at least partially submerged with the solution 13 and are connected to a power supply.

Figure 3:
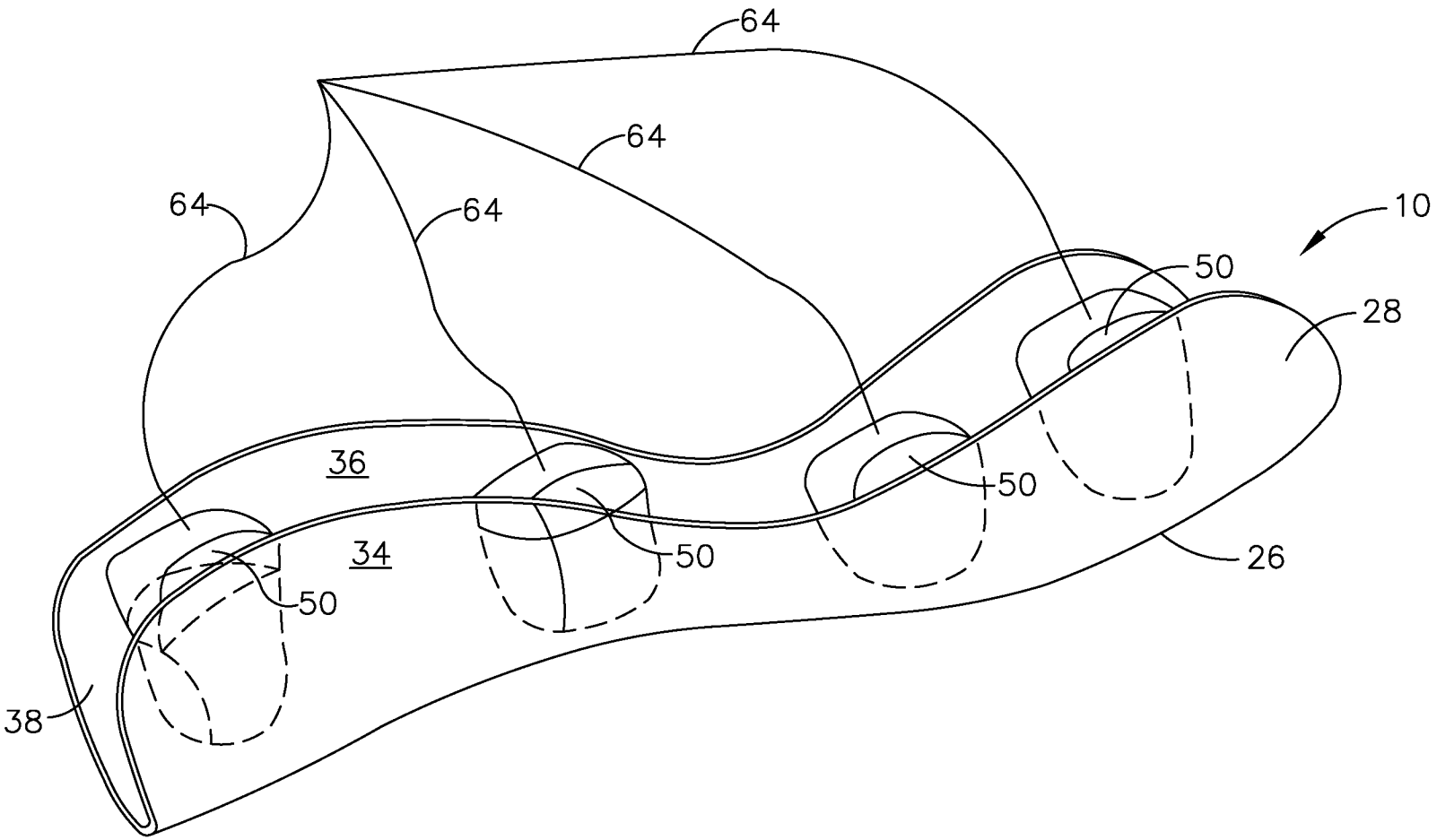
FIG. 3 is a perspective view of a MLE and electrodes.

As shown in FIG. 3, multiple electrodes 50 can be positioned within the cavity 38 of the MLE 10.

The technology described herein can be better understood through a description of the operation thereof. A location for positioning the electrode 50 within the MLE cavity 38 is determined. Preferable locations for electrode 50 include those that are located within cavity 38 such that they are opposite areas where enhanced polishing on the outer surface 34 of the MLE 10 is needed. Such areas are often those associated with a complex geometry. The electrode 50 is then placed within the cavity 38 at the determined location and positioned such that the electrode outer surface 54 is in contact with the inner surface 36 of the MLE 10. Preferably, the electrode 50 is positioned such that the electrode outer surface 54 of the electrode 50 is in substantially continuous contact with the inner surface 36.

The MLE 10 and the electrode 50 is then placed within the tank 12 such that at least portions of the MLE 10 and the electrode 50 are covered by the electrolyte solution 13. It should be appreciated that the electrolyte solution 13 can be added to the tank 12 either before or after the MLE 10 is positioned within the tank 12. The electrode 50 is electrically connected to an electrical pole of the power supply via the electrical connector 64. An electrical current is passed between the cathodes 14 and 16 and the electrode 50. Because the MLE 10 is electrically connected to cathodes 14 and 16 via the electrode 50 and the connector 64, the MLE 10 effectively acts as the anode and material is removed from the surface of the MLE 10. In this manner material is removed from the outer surface 34 of the MLE 10 such that MLE 10 is polished.

Figure 4:
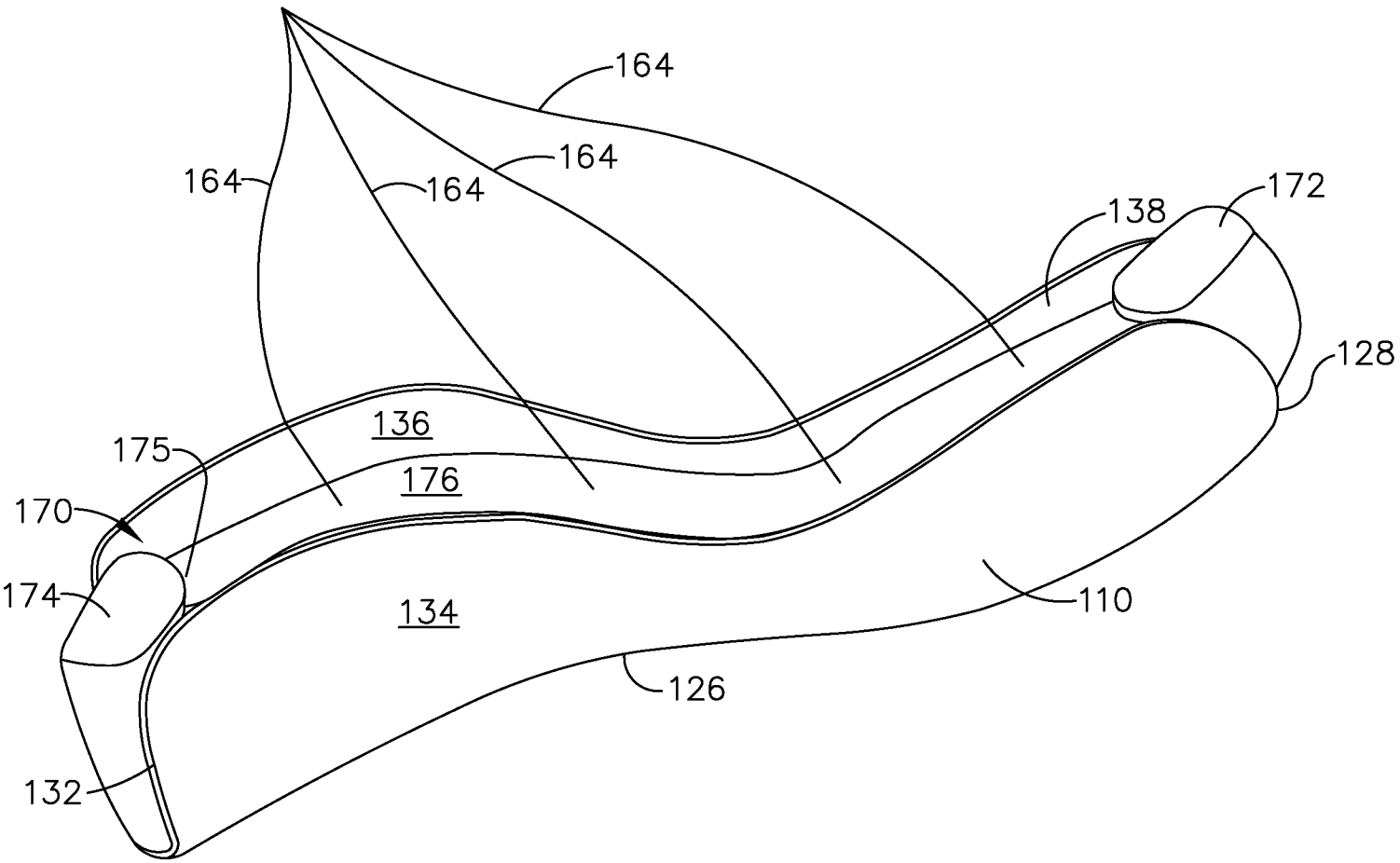
FIG. 4 is a perspective view of an alternative metal leading edge and electrode configuration.

Referring now to an alternate embodiment as shown in FIG. 4, similar reference numbers in the 100 series refer to elements that are substantially similar to those associated with similar reference numbers described above. The MLE 110 has a generally u-shaped cross section and includes a leading tip 126. The MLE 110 includes a first end 128 and a second end 132 and defines an exterior surface 134 and an inner surface 136. The inner surface 136 defines a cavity 138.

An electrode 170 is positioned with the cavity 138. The electrode 170 includes a first dam 172 positioned at the first end 128 and a second dam 174 positioned at the second end 132. The first dam 172 and the second dam 174 are removable fixtures that will be removed from the MLE after an electro-polishing process. A plug 176 is positioned between the first dam 172 and the second dam 174. The plug 176 is formed of a conductive substance and is formed to be in direct contact with the inner surface 136 of the MLE 110. The plug 176 is a low-melt alloy. By way of example and not limitation, the plug 176 can be formed of one of the following: bismuth based alloys containing lead, tin, cadmium or other metals; copper based alloys; iron based alloys; aluminum based alloys; silver; gold; and a combination thereof. The electrode 170 is electrically connected to at least one conductor 164. In the illustrated embodiment, at least an end of a plurality of conductors 164 is embedded in the plug 176. Alternatively, the conductors can be electrically connected to at least one of the first dam 172, the second dam 174, the plug 176, and a combination thereof. The electrical connection can be via a terminal.

The electrode 170 is formed according to the following method: The first dam 172 is positioned within the cavity 138 of the MLE 110 at the first end 128. The second dam 174 is positioned within the cavity 138 of the MLE 110 at the second end 132. The first dam 172 and the second dam 174, in conjunction with a portion of the inner surface 136, define an electrode region 175. To form the plug 176, material is melted during a melting process and poured into the electrode region 175. In accordance with the illustrated embodiment, the material is allowed to solidify before use.

The electrode 170 is used during an electro-polishing process as described above with respect to electrode 50. When the polishing process is complete the plug 176 and the first and second dams 172 and 174 are removed from the MLE 110. It should be appreciated that the plug 176 can be removed by melting or other suitable method.

The invention is an apparatus and method for providing precisely positioned electrical contact to complex shapes during an electro-polishing process.

The commercial advantages of the disclosed technology include minimized damage caused by the electro-polishing process and better polishing of complex shapes. One advantage of the disclosed technology when compared with conventional electro-polishing technologies is a reduction in the amount of racking, fixture marks, and burns that can be caused during a conventional electro-polishing process. Such a reduction is achieved because the conductor acts as a fixture. In this regard, the larger surface area of the conductor relative to conventional conductors distributes the potentially damaging mechanical and electrical forces associated with conventional electro-polishing conductors. Another advantage of the presently disclosed technology over conventional electro-polishing technology is that the contactors can be positioned and shaped such that electro-polishing is preferentially achieved in areas that would not be as well polished using conventional methods.

The foregoing has described an apparatus and method for electro-polishing a complex shape such as a metal leading edge for use in a gas turbine engine. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. An apparatus for electro-polishing an object that has a complex shape, the object having a wall that defines a first surface to be polished and a second surface, the second surface defining a cavity, the apparatus comprising:

multiple electrodes that are configured to closely engage predetermined locations of the object, the electrodes being positioned in the cavity in contact with the second surface such that outer surfaces of the electrodes are in substantially continuous contact with the second surface: and wherein the electrodes are configured to be electrically connected to a power supply.

2. The apparatus for electro-polishing an object according to claim 1, wherein the shape of the electrodes are defined by the shape of the object.

3. The apparatus for electro-polishing an object according to claim 2, wherein the electrodes are defined by the shape of the object and at least one removable fixture.

4. The apparatus for electro-polishing an object according to claim 1, wherein the object to be electro-polished is a component from an aircraft engine.

5. The apparatus for electro-polishing an object according to claim 4, wherein the object to be electro-polished is a metal leading edge configured to be attached to a fan blade.

6. A method for electro-polishing metal, the method comprising the steps of:

providing an object that has a wall and the wall defines a first surface that is to be polished and a second surface;

positioning multiple electrodes on the object to be polished such that an outer surface of each electrode is in substantially continuous contact with the second surface;

connecting the electrode to a power supply;

placing the object to be polished in an electrolyte solution such that the object is an anode; and passing current through the electrode.

7. The method according to claim 6, wherein a cathode is electrically connected to the power supply and is positioned in the electrolyte solution.

8. A method for electro-polishing an object that defines an open-ended cavity, the method comprising the steps of:

positioning a first dam at a first end of the cavity;

positioning a second dam at a second end of the cavity such that an electrode region is defined;

filling the electrode region with a metal to form an electrode;

electrically connecting the electrode to a power supply;

placing the object to be polished in an electrolyte solution; and passing current through the electrode such that the object is an anode.

9. The method for electro-polishing an object according to claim 8, wherein the method further comprises the steps of:

removing the electrode from the object.

10. The method for electro-polishing an object according to claim 9, wherein the step of removing includes melting a portion of the electrode.

11. The method for electro-polishing an object according to claim 10, further comprising the step of removing the first and second dams.

* * * * *